US006134732A

United States Patent [19]

Chapman et al.

[11] Patent Number: 6,134,732

[45] Date of Patent: Oct. 24, 2000

[54] ALTERNATING PAD

[75] Inventors: Paul William Chapman; Veronica Irene Fletcher; Clive Russel Perry, all of Bedfordshire, United Kingdom

[73] Assignee: Huntleigh Technology PLC, United Kingdom

[21] Appl. No.: 09/117,564

[22] PCT Filed: Nov. 26, 1997

[86] PCT No.: PCT/GB97/03238

§ 371 Date: Jul. 28, 1998

§ 102(e) Date: Jul. 28, 1998

[87] PCT Pub. No.: WO98/23189

PCT Pub. Date: Jun. 4, 1998

[51] Int. Cl.[7] ..... A61G 7/057

[52] U.S. Cl. ..... 5/710; 5/713; 5/715; 5/711

[58] Field of Search ..... 5/710, 711, 712, 5/713, 714, 715

[56] References Cited

U.S. PATENT DOCUMENTS

| | | | |
|---|---|---|---|
| 1,772,310 | 8/1930 | Hart | 5/713 |
| 3,678,520 | 7/1972 | Evans | 5/713 |
| 4,267,611 | 5/1981 | Agulnick | 5/713 |
| 4,391,009 | 7/1983 | Schild et al. | 5/714 X |
| 4,472,847 | 9/1984 | Gammons et al. | 5/714 X |
| 5,189,742 | 3/1993 | Schild | 5/713 |

FOREIGN PATENT DOCUMENTS

| | | | |
|---|---|---|---|
| WO 86/05973 | 10/1986 | European Pat. Off. . | |
| 2090734 | 6/1982 | United Kingdom . | |
| 2167293 | 5/1986 | United Kingdom . | |
| 2197192 | 5/1988 | United Kingdom | 5/713 |

*Primary Examiner*—Michael F. Trettel
*Attorney, Agent, or Firm*—Brown Raysman Millstein Felder & Steiner LLP

[57] ABSTRACT

An alternating pressure pad includes a first series and a second series of inflatable cells. The first and second series of inflatable cells are interleaved, with one series within the other series. Each cell of the first series of inflatable cells and each cell of the second series of inflatable cells extends transversely across the alternating pressure pad and defines a non-linear and non-repeating path, with the path defined by substantially all of the cells of the first series being identical to the path defined by substantially all of the cells of the second series.

20 Claims, 1 Drawing Sheet

ALTERNATING PAD

BACKGROUND OF THE INVENTION

1. Field of the Invention

This invention relates to alternating pressure ads, and in particular to alternating pressure pads of the kind used in the prevention and management of decubitous ulcers in bedridden patients.

2. Discussion of the Related Art

The formation of decubitous ulcers, commonly known as bed sores, results from, amongst other things, the pressure applied to certain portions of the skin of a bedridden patient. It is known to meet the requirement for the prevention and management of decubitous ulcers with an alternating pressure pad comprising two series of alternatively inflatable cells which are interleaved, one series within the other. The cells are alternately inflatable to support a patient at different locations. Typically, inflation and deflation cycles may last from under two minutes for a gentle massaging effect to over twenty minutes.

Patient comfort dictates that support provided by a given region of a pad is not affected by the pressure applied by a patient to adjacent regions. Therefore, a pad of small cells is more comfortable to the patient than a pad of large cells, and a pad comprising small cells in a zig-zag or T-shape or similar path across the pad provides optimum comfort.

However, these small cell pads are unable to support the heavier patients or the larger bony protuberances of even relatively light patients unless pressurised to an uncomfortably high support pressure.

Consequently, in order to provide sufficient support it has been found necessary to use pads with large cells which inflate to a greater thickness and at a lower, more comfortable pressure. Typically, large cells have been used in the form of an elongate cylinder extending linearly straight across a pad. However, these pads have experienced problems of large areas of the body being left unsupported, or the areas supported feeling uncomfortable leading to patient discomfort and uneasiness. The cells have also been unable to prevent bony protuberances falling between the inflated cells and resting on the mattress beneath, or bottoming of the patient in the semi-recumbant position where the cells are prone to separate out under the patient's sacrum.

Reconciling the advantages of small cells to large cells has hitherto been accomplished by providing double layer small cell pads or smaller diameter cells under the heels of the patient.

SUMMARY OF THE INVENTION

The present invention seeks to provide an improved large cell alternating pressure pad.

In accordance with the present invention, an alternating pressure pad comprises at least a first and a second series of alternately inflatable cells, which are interleaved, one series within the other, each cell extending transversely across the pad and defining a non-linear, non-repeating path wherein substantially all of the cells define the same path.

The non-linear path of the cells provides a greater length of each cell in contact with the body with improved comfort since more of the patient is supported at any one time. We have found that due to the increased contact area a lower average interface pressure is achieved than that achieved with pads having the conventional linear transverse arrangement of such cells.

According to another aspect of the invention, an alternating pressure pad comprises alternately inflatable transverse cells including at least one longitudinal cell underlying each opposite end of the transverse cells, the longitudinal cells inflated at constant pressure. The longitudinal cells extend along the length of the pad and, in use, a surface which curves around a patient lying thereon is provided such that the area of the patient supported at any one time is increased, the increased contact area resulting in lower interface pressures and improved comfort for the patient.

In the preferred embodiment the cells define a sinusoidal path.

Preferably, each cell path defines substantially a U-shape located centrally of the pad. The location of the U-shape centrally of the pad provides a two-dimensional and hence greater pressure distribution, the patient being supported across the back by the central curve of the U-shape and also supported along the sides of the body by the arms of the U-shaped cell.

Preferably, the arrangement of cells in their respective series along the length of the pad comprises the central curve of the U-shape of one cell path in a series corresponding horizontally with the tops of the arms of the U-shape of the next following cell path in the same series. This unique profile of the cells paths provides an advantageous overlap effect which ensures that the support to the patient is maintained and reduces the likelihood of the patient bottoming and coming to rest on the mattress beneath, especially in the semi-recumbant position. The unique profile further reduces the likelihood of the patient sliding down the pad, a problem normally encountered with the conventional transverse linear celled alternating pads.

Preferably, the cell path may define a V-shape centrally of the pad.

Preferably, the cell(s) for supporting the head of a patient are inflated at constant pressure, to avoid uncomfortable pad induced head movement.

Preferably, the alternately inflatable cells are inflated simultaneously. The simultaneous inflation of all the cells provides a static pad to provide constant support.

Preferably, manifolds and cell connections for feeding fluid to the cells are located beneath the pad on the outer curved ends of the transverse cells, providing a larger unimpeded patient support area.

Preferably, the longitudinal cells may comprise the manifolds for feeding fluid to the transverse cells.

Preferably, there are a plurality of longitudinal cells arranged adjacent to each other in a direction inwardly of the pad and more preferably the cells are each of decreasing diameter than the outer adjacent cell, for improved 'cradle' effect.

Preferably, a sensor is arranged to be located beneath the pad and disposed inbetween the longitudinal cells, the sensor being further connected to the manifolds for fluid to flow through the sensor to exhaust, the sensor reducing the air flow to exhaust from each of manifolds during inflation of the corresponding series of transverse cells if the pad is insufficiently inflated to support a patient thereon. In this way optimal patient support pressure is provided.

It will also be apparent that although the present invention will find substantial applications as a form of mattress or overlay, it may also be modified for use in a wide variety of other applications, for instance on seats and particularly wheelchair seats.

BRIEF DESCRIPTION OF THE DRAWINGS

Examples of the invention will now be described with reference to the accompanying drawings, in which.

DETAILED DESCRIPTION OF THE PREFERRED EMBODIMENTS

Figure 1:
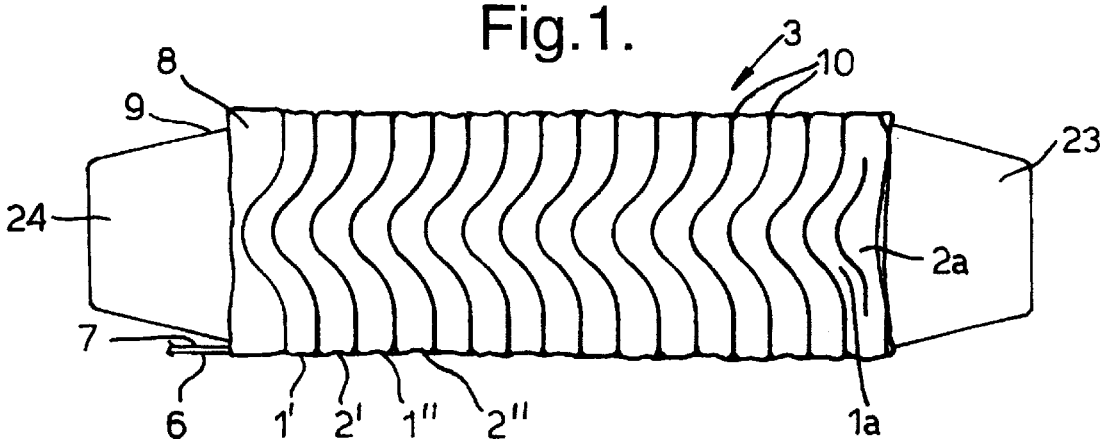
FIG. 1 is a perspective view of an embodiment of an alternating pressure pad according to the invention.

Referring now to FIG. 1, the alternating pressure pad includes a first series of cells 1 formed by alternate cells 1', 1", etc., and a second series of cells 2 formed by cells 2', 2", etc., the two series interleaved to form a pad 3. The two series of cells 1 and 2 are alternately inflatable and are supplied with air from a compressor feeding a rotary valve. The first and second series are supplied air from respective manifolds 6 and 7. It is envisaged that cells in series of three or more may also be used or that more than one cell in any one series may be inflated alternately. Generally, the cells are shaped as elongate cylinders which in the preferred embodiment extend transversely across the pad along a sinusoidal path.

The cells may be individually formed and restrained onto a base sheet along a sinusoidal path to form the alternating pressure pad or in accordance with the preferred embodiment, the alternating pressure pad may be made from top 8 and bottom 9 sheet material welded together to define alternately inflatable cells. The alternating pressure pad may also comprise sections made from top 8 and bottom 9 sheet material welded together to define alternately inflatable cells. The welds 10 define the sinusoidal path transversely of the pad.

Figure 2:
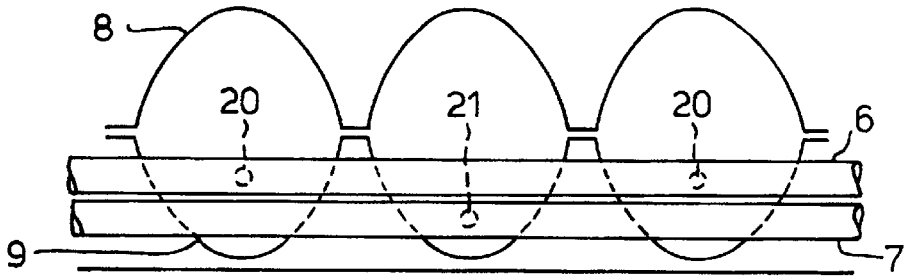
FIG. 2 shows the arrangement of the manifolds suitable for feeding fluid to the cells in FIG. 1.
Figure 3:
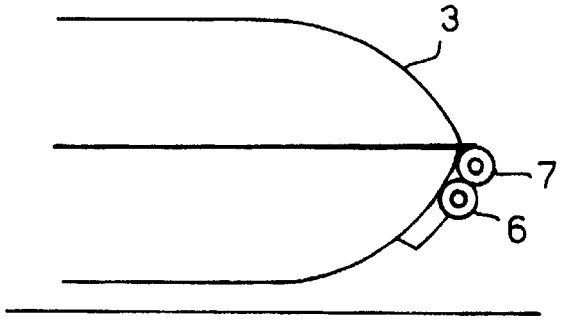
FIG. 3 is a cross-sectional view of the manifolds in FIG. 2.

The series of cells are supplied with fluid by manifolds 6 and 7 which run along the side of the cells. Two such manifolds are shown in FIG. 2, one manifold feeding each series of cells. The manifolds 6 and 7 are connected to the series of the cells by connectors 20 and 21. Connectors 20 are located at positions along the manifold 6 to feed fluid to one series of cells and connectors 21 are located at positions along manifold 7 to feed fluid to the other series of cells. As shown in FIG. 3, both the connectors and manifolds are located on the curved ends of the cells to provide a larger unimpeded area for the patient to lie on. The two head section cells 1*a* and 2*a* are connected to the respective manifolds via one-way valves so that the cells retain a constant pressure throughout the inflation and deflation cycles of the rest of the cells.

In another aspect of the invention, an alternating pressure pad additionally comprises longitudinal cells 13 and 14 underlying the alternating inflatable transverse cells in a pad. The transverse cells may be as shown in FIG. 1 or any other form available in the art. The longitudinal cells 13 and 14 extend the length of the pad and support the pad at opposite sides thereof. The longitudinal cells are at constant pressure and when inflated provide a surface which curves around a patient lying thereon, giving a desirable cradling feeling to the patient.

Figure 4:
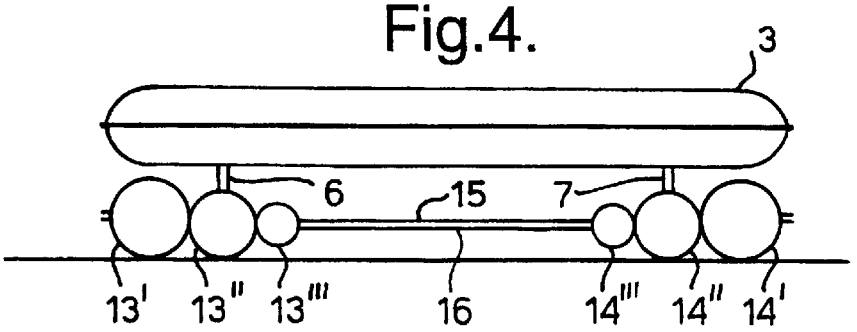
FIG. 4 is a schematic view of another aspect of an alternating pressure pad according to the invention.

Referring now to FIG. 4, in a preferred embodiment, the longitudinal cells may be made from top 15 and bottom 16 sheet material of the same length and width as the pad material 8,9 and welded together to form respectively three interconnected longitudinal cells 13',13", 13'" and 14', 14", 14'" at the opposite sides. The longitudinal cells at each side are arranged adjacent each other and of successively decreasing diameter size in order to provide an optimum curved surface when a patient is lying thereon.

The longitudinal cells can be connected to the pad and inflated in various ways. In the preferred embodiment, in FIG. 4, one each of the longitudinal cells 13" and 14" comprise the manifolds themselves, each connecting along their lengths with respective transverse cells to feed fluid thereto and both feeding fluid to the other longitudinal cells 13', 13'", 14', 14'". Similarly, only one longitudinal cell may be arranged to comprise connectors at either side thereof with a separating weld between the two sets of connectors feeding the respective transverse cells and both the connectors feeding the or other longitudinal cells.

Alternatively, the manifolds 6 and 7 in FIG. 2 may comprise additional connectors 20 and 21 both connecting the or each longitudinal cell.

Additionally, the top 15 and bottom 16 sheets may further define a sensor pad in between the longitudinal cells 13 and 14. The sensor pad is described in our patents GB2233551 and GB2258808 and is hereby incorporated by reference.

The alternating pressure pads according to the invention also include flaps 23 and 24 extending from each head and foot sections of the pad to secure the pad onto a mattress on a bed.

What is claimed is:

1. An alternating pressure pad comprising:

a first series of transverse inflatable cells;

a second series of transverse inflatable cells;

a plurality of longitudinal inflatable cells;

wherein the first and second series of transverse inflatable cells are positioned substantially adjacent to each other in a longitudinal direction, with each transverse inflatable cell extending in a transverse direction to the longitudinal direction;

wherein each transverse inflatable cell defines a non-linear, non-repeating path common to the other transverse inflatable cells of the first and second series;

wherein the transverse inflatable cells of the first and second series are alternately arranged to be interleaved, with the first series positioned within the second series;

wherein each of the plurality of longitudinal inflatable cells extends in the longitudinal direction, with a first set of the longitudinal inflatable cells being positioned outward in the transverse direction relative to a second set of the longitudinal inflatable cells; and wherein the respective transverse widths of the second set of the longitudinal inflatable cells are smaller than the respective transverse widths of the first set of the longitudinal inflatable cells.

2. The alternating pad of claim 1, wherein the transverse cells define sinusoidal paths.

3. The alternating pad of claim 1, wherein each of the sinusoidal paths defines substantially a U-shape located centrally of the transverse inflatable cells.

4. The alternating pad of claim 1, wherein the arrangement of the transverse inflatable cells in their respective series along the longitudinal direction has, for each cell having a respective path with a central curve of a U-shape, each cell path in a respective series corresponding horizontally with the tops of the arms of a U-shape of the next following cell path in the same series.

5. The alternating pad of claim 1, wherein the cell path defines a V-shape.

6. The alternating pad of claim 1, further comprising:

at least one manifold; and at least one cell connection;

wherein the at least one manifold and the at least one cell connection supply fluid to the transverse inflatable cells in the first series and second series.

7. The alternating pad of claim 6, wherein the at least one manifold and the at least one cell connection are located beneath the first and second series of transverse inflatable cells and on an outer curved end of the cells in the first series of inflatable cells and of the cells in the second series of inflatable cells.

8. The alternating pad of claim 1, further comprising:

a head support for supporting the head of an individual.

9. The alternating pad of claim 1, wherein the transverse inflatable cells are inflated simultaneously.

10. The alternating pad of claim 1, wherein the transverse inflatable cells are inflated at a constant pressure.

11. The alternating pad of claim 1, wherein the plurality of longitudinal cells underlie opposing ends of the transverse inflatable cells.

12. The alternating pad of claim 1, wherein the plurality of longitudinal cells are inflated at a constant pressure.

13. The alternating pad of claim 1, further comprising:

a sensor pad positioned beneath the first and second series of transverse inflatable cells; and a plurality of manifolds connected to the sensor to facilitate the flow of fluid through the sensor pad;

wherein the sensor pad, responsive to the transverse inflatable cells being insufficiently inflated to support a person thereon, reduces air flow from each of the plurality of manifolds during inflation of the transverse inflatable cells.

14. An alternating pressure pad comprising:

a plurality of transverse inflatable cells;

a plurality of longitudinal inflatable cells;

wherein the transverse inflatable cells are positioned substantially adjacent to each other in a longitudinal direction, with each transverse inflatable cell extending in a transverse direction to the longitudinal direction;

wherein each transverse inflatable cell defines a non-linear, non-repeating path common to the other transverse inflatable cells;

wherein each of the plurality of longitudinal inflatable cells extend in the longitudinal direction, with a first set of the longitudinal inflatable cells being positioned outward in the transverse direction relative to a second set of the longitudinal inflatable cells; and wherein the respective transverse widths of the second set of the longitudinal inflatable cells are smaller than the respective transverse widths of the first set of the longitudinal inflatable cells, thereby forming a cradle in which a patient lying on the transverse inflatable cells is disposed.

15. The alternating pad of claim 14, wherein the transverse cells define a sinusoidal path.

16. The alternating pad of claim 14, wherein each of the sinusoidal paths defines substantially a U-shape located centrally of the transverse inflatable cells.

17. The alternating pad of claim 14, wherein the arrangement of the transverse inflatable cells in their respective series along the longitudinal direction has, for each cell having a respective path with a central curve of a U-shape, each cell path in a respective series corresponding horizontally with the tops of the arms of a U-shape of the next following cell path in the same series.

18. The alternating pad of claim 14, wherein the cell path defines a V-shape.

19. The alternating pad of claim 14, further comprising:

at least one manifold; and at least one cell connection;

wherein the at least one manifold and the at least one cell connection supply fluid to the cells in the first series of inflatable cells and to the cells in the second series of inflatable cells.

20. A method for supporting a patient, comprising the steps of:

providing an alternating pad having:

a first series of transverse inflatable cells;

a second series of transverse inflatable cells; and a plurality of longitudinal inflatable cells;

wherein the first and second series of transverse inflatable cells are positioned substantially adjacent to each other in a longitudinal direction, with each transverse inflatable cell extending in a transverse direction to the longitudinal direction;

wherein each transverse inflatable cell defines a non-linear, non-repeating path common to the other transverse inflatable cells of the first and second series;

wherein the transverse inflatable cells of the first and second series are alternately arranged to be interleaved, with the first series positioned within the second series;

wherein each of the plurality of longitudinal inflatable cells extend in the longitudinal direction, with a first set of the longitudinal inflatable cells being positioned outward in the transverse direction relative to a second set of the longitudinal inflatable cells; and wherein the respective transverse widths of the second set of the longitudinal inflatable cells are smaller than the respective transverse widths of the first set of the longitudinal inflatable cells;

positioning the patient upon the first and second series of transverse inflatable cells; and cradling the patient using the decreasing transverse widths of the longitudinal inflatable cells from the first set to the second set of longitudinal cells.

* * * * *